US005347244A

United States Patent [19]

Monti

[11] Patent Number: 5,347,244

[45] Date of Patent: Sep. 13, 1994

[54] BROADBAND DIRECTIONAL COUPLER USING CABLES

[75] Inventor: Osvaldo Monti, Montreal, Canada

[73] Assignee: Canadian Marconi Company, Montreal, Canada

[21] Appl. No.: 998,054

[22] Filed: Dec. 29, 1992

[51] Int. Cl.[5] ..... H01P 5/18; H01R 43/00

[52] U.S. Cl. ..... 333/115; 29/872

[58] Field of Search ..... 333/115; 29/600, 828, 29/868, 872, 873

[56] References Cited

U.S. PATENT DOCUMENTS

| | | | |
|---|---|---|---|
| 2,562,281 | 6/1944 | Mumford . | |
| 2,657,361 | 1/1950 | Henning . | |
| 3,358,248 | 12/1967 | Saad . | |
| 3,416,102 | 12/1968 | Hamlin | 333/115 |
| 4,547,753 | 10/1985 | Chapell | 333/115 |

FOREIGN PATENT DOCUMENTS

| | | | |
|---|---|---|---|
| 561242 | 9/1977 | U.S.S.R. | 333/115 |

OTHER PUBLICATIONS

Sage Laboratories, Inc., pp. 70, 74, 99, 100, "Wireline & Wirepac." (undated).

*Primary Examiner*—Paul Gensler

*Attorney, Agent, or Firm*—Oblon, Spivak, McClelland, Maier & Neustadt

[57] ABSTRACT

A broadband directional coupler and method of constructing same is disclosed. The coupler is formed from a first and second coaxial cable each of which has an inner conductor surrounded by an insulating material and an outer conductive shielding sleeve about the insulating material. An elongated opening is formed in the outer conductive shield sleeve axially along a predetermined length of the cable. The insulating material in the elongated openings is formed with mating surfaces extending substantially parallel to the inner conductor along a predetermined length. The first and second coaxial cables are connected together along a predetermined length of the mating surfaces with the surfaces in juxtaposed contact and the shielding sleeves of the first and second cables fused together about the elongated opening.

13 Claims, 2 Drawing Sheets

BROADBAND DIRECTIONAL COUPLER USING CABLES

TECHNICAL FIELD

The present invention relates to a broadband directional coupler formed by using commercially available coaxial cables, and preferably but not exclusively, semi-rigid coaxial cables which are stripped and fused together to achieve the required coupling. A semi-rigid cable is formed by a solid metal sheath, usually copper, and is filled with a dielectric, usually solid polytetrafluoroetylene (PTFE), which envelopes a center conductor. It is usually easy to form, by hand, or by using simple tooling.

BACKGROUND ART

Coaxial directional couplers are known, such as disclosed, for example, in U.S. Pat. No. 2,657,361 and 3,358,248. However, known coaxial directional couplers are relatively expensive to produce due to their structure and the fact that their physical dimensions must be changed with different operating applications of the coupler. The most common type of coupler in the field of this invention utilizes solid stripline construction techniques. In such techniques it is required, as shown for example in U.S. Pat. No. 4,547,753, to couple the coaxial cables within a machined metal housing or other form of housing for shielding, and the housing is then filled with a sealant, such as epoxy, in order to make the unit impervious to humidity and other environmental hazards. Accordingly, known couplers are expensive to fabricate as the manufacturing process is relatively lengthy as well as the design time.

A further disadvantage of some of these coupler designs is that their size can be fairly large depending on their frequency coupling, and cannot be fitted in restrained spaces. They do not offer flexibility.

SUMMARY OF INVENTION

It is a feature of the present invention to provide a broadband directional coupler constructed from coaxial cables and preferably, but not exclusively, commercially available semi-rigid coaxial cables, and which substantially overcomes the above-mentioned disadvantages of the prior art.

According to the above feature, from a broad aspect, the present invention provides a broadband directional coupler which comprises a first and second coaxial cable each having an inner conductor surrounded by an insulating material and an outer conductive shielding sleeve about the insulating material. An elongated opening is provided in the outer conductive shielding sleeve and formed along a predetermined length thereof. The insulating material adjacent to the elongated openings is formed with mating surfaces, typically, but not necessarily flat, extending substantially parallel to the inner conductor along a predetermined length. Means is provided to connect the first and second coaxial cable to each other along the predetermined length of the mating surfaces with the surfaces in juxtaposed contact, and the shielding sleeve of the first and second cables in contact with one another about the elongated openings.

According to a still further broad aspect of the present invention, there is provided a method of constructing a broadband directional coupler from a first and second coaxial cable, each cable having an inner conductor surrounded by an insulating material and an outer conductive shielding sleeve about the insulating material. The method comprises cutting an elongated opening in the conductive shielding sleeve along a predetermined axial length. The insulating material is formed with a typically flat mating surface along a predetermined length in the elongated opening with the mating surface extending substantially parallel to the inner conductor. The mating surface of the first and second coaxial cables are placed in facial juxtaposed contact. The first and second coaxial cables are connected to each other along the predetermined length of the flat mated surfaces with the shield sleeve of the first and second coaxial cables in shielding contact with one another about the window openings.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
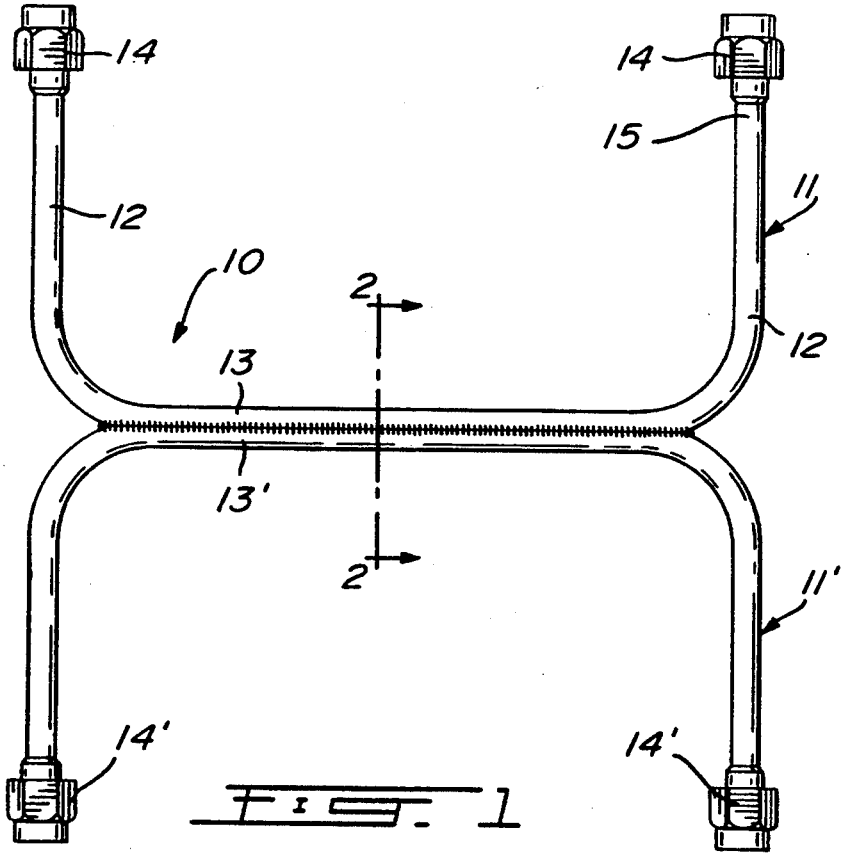
FIG. 1 is a plan view showing the construction of the broadband directional coupler of the present invention formed by stripping and using two commercial semi-rigid coaxial cables together.

Referring now to the drawings, there is shown generally at 10 in FIG. 1 the broadband directional coupler of the present invention. The coupler comprises a first coaxial cable section 11 of generally U-shape configuration defining opposed leg sections 12 and an intermediate straight section 13. A coaxial connector 14 may or may not be secured to the free ends 15 of the leg sections. The leg sections 12 which are shown straight in FIG. 1 can be formed to any convenient shape in order to facilitate circuit integration. A second coaxial cable 11' of like configuration is coupled to the first cable along their intermediate straight sections 13 and 13' in a manner as will be described later.

Figure 2:
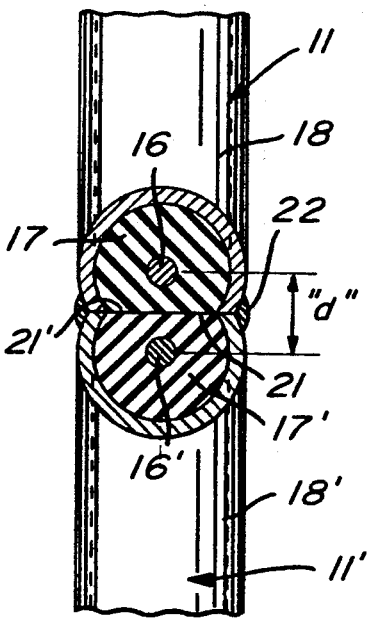
FIG. 2 is a section view along section lines 2—2 of FIG. 1.
Figure 3:
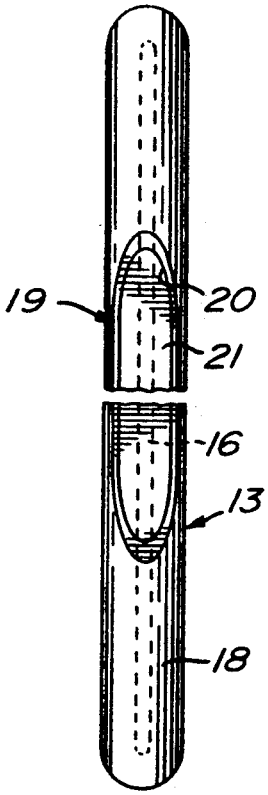
FIG. 3 is a plan view illustrating the cut-out portion along the intermediate coaxial cable section forming the mating surfaces of both cables, as illustrated in FIG. 1.
Figure 4:
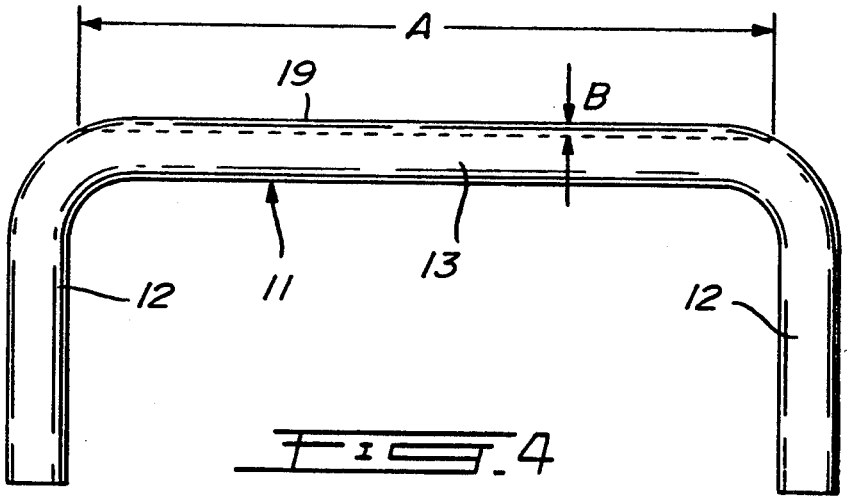
FIG. 4 is a side view of one U-shape coaxial cable section illustrating various parameters of the section considered in designing the broadband directional coupler of the present invention.
Figure 5:
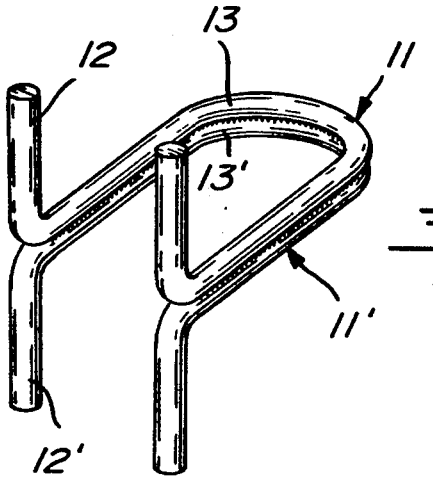
FIG. 5 is a perspective view of the coupler having its mated section curved to reduce its shape.
Figure 6:
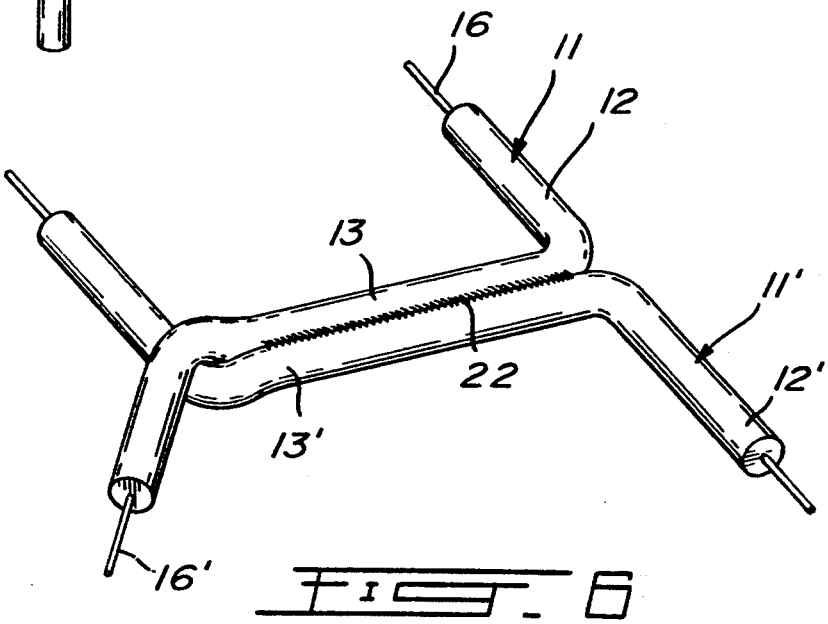
FIG. 6 is a perspective view of the coupler which in this example has no connectors, having its mated section twisted to change the topology of its inputs and outputs.

With further reference to FIG. 2 to 4, and particularly as shown in FIG. 2, each coaxial cable 11 and 11' is formed with an inner central conductor 16 and 16' respectively surrounded by an insulating material 17 and 17', such as PTFE, with an outer conducting shielding sleeve 18 and 18', respectively, secured about the insulating material. Preferably, but not exclusively, the cable is a semi-rigid coaxial cable with the shielding sleeve being formed of metal, usually copper or plated aluminum tubing which can be bent to provide a coupler of different configuration, as shown in FIGS. 5 and 6.

As shown in FIGS. 3 and 4, the intermediate straight section 13 of each of the two cables is machined along an outer surface area 19 to form a window opening or an elongated opening 20 within the conductive shielding sleeve 18, and further to form a flat mating surface 21 and 21' respectively in both of the intermediate straight coaxial cable sections 13 and 13' to be mated and interconnected. The insulation 17 can easily be machined to dimensions of down to 1 mm from the central conductor 16, which is suitable for coupling factors of 10 dB or lower. Tighter coupling factors are possible, but required tolerances become more difficult to achieve. The elongated opening 20 and the mating surfaces 21 are of a predetermined length and depth depending on the desired characteristics of the coupler. The mating surfaces 21 of both cables 11 and 11' are placed in juxtaposed contact and the shielding sleeve about the openings 20 are fused or welded together with a solder material 22, as shown in FIG. 2. The solder is formed all about the openings to interconnect the cables together in a configuration, as shown in FIG. 1, and to shield the inner conductors.

Although the straight intermediate coupled sections of the cable are shown interconnected by welding the conductive outer shield together, it is conceivable that they may be interconnected together by other means, such as a conductive clamping sleeve (not shown), etc., but the fusing technique seems to be the most economical one considered. As can be appreciated, the performance characteristics of the coupler of the present invention are easily reproduced at very low cost as compared with the prior art couplers. A broadband coupler of the present invention operates within a bandwidth of from about 600 to 1000 MHz with a 30 dB directivity and has a low VSWR of 1.1/1 in both the first and second coaxial cables. Directivity is a quality factor related to directional couplers and defines the amount of power appearing at the uncoupled port. Directivity is equal to isolation minus coupling. The design parameters of such couplers are well covered in the prior art.

There are several limiting and controlling factors on directivity. One factor is the uniformity of propagation of the even and odd mode waves within the coupler. The second is the internal match of the coupler which is the function of the balance of these even and odd mode impedances. The third factor is the end function mismatches, and a fourth factor is the load VSWR on the main and secondary output ports. By control of the load impedance as well as by careful matching of the end discontinuities, we have built directional couplers of this type having directivities in the range of 30 dB. Most known directional couplers are specified with directivity values in the order of about 20 dB.

The electromagnetic coupling is effected between the two central conductors 16 and 16' in their configuration, as shown in FIG. 2. The distance d between these conductors is selected to suit the characteristics of the coupler, and these are spaced apart usually a distance greater than 2 mm. A suitable jig is utilized in order to ensure that the machining of the surface 19 is effected very precisely leaving a mating surface 21 which is substantially parallel to the central conductor 16.

Referring now to FIG. 5, there is shown the coupler of the present invention wherein the fused intermediate sections 13 and 13' are bent to reduce the configuration of the coupler depending on the packaging requirements.

Referring now to FIG. 6, there is shown the coupler of the present invention wherein the fused intermediate sections are twisted to change the topology of the inputs and outputs.

The design parameters of couplers are well defined in the prior art, suffice only to say that such have now been achieved by a broadband directional coupler using commercial semi-rigid coaxial cables, or other suitable types of coaxial cables, that can be stripped and fused together thereby eliminating the need of providing a mechanical housing for packaging the coupler or other complex design structures. Accordingly, a low-cost coupler is provided which meets the required performance objectives.

Briefly summarizing the method of constructing the broadband directional coupler of the present invention, two coaxial cables of predetermined lengths are machined along a predetermined outer surface area to cut an elongated opening in the conductive shielding sleeve as well as to machine a flat mating surface in the insulating material of the coaxial cable and spaced from the center conductor. The flat mating surfaces are placed in juxtaposed contact and the metal shield of both cable lengths are welded about the openings formed therein to interconnect the cable sections together to form the coupler. The connectors 14, if required, secured to the end of the opposed leg sections 12 can be secured before or after the machining or fusing of the cables together. Of course, prior to effecting the machining operation, it is necessary to determine the precise predetermined lengths for the machining depending on the required frequency characteristics of the coupler. The depth of machining within the cable is dependent on the coupling requirements between both conductors of the interconnected cables.

It is within the ambit of the present application to cover any obvious modifications of the preferred embodiment described herein provided such modifications fall within the scope of the appended claims.

I claim:

1. A broadband directional coupler comprising a first and second flexible coaxial cable each having an inner conductor surrounded by an insulating material and a semi-rigid outer conductive shielding sleeve about said insulating material, an elongated opening in said outer conductive shielding sleeve and formed axially along a predetermined length thereof, said insulating material adjacent said elongated opening having a flat mating surface extending substantially parallel to said inner conductor along a predetermined length, and means to connect said first and second coaxial cables to each other along said predetermined length of said mating surfaces about said elongated openings with said surfaces in juxtaposed contact and said shielding sleeve of said first and second cables in shielding contact with one another about said elongated openings, said inner conductor of said first and second flexible coaxial cables being disposed in parallel alignment to one another along said predetermined length, said mating surface being disposed at a predetermined depth in said insulating material and spaced from said inner conductor whereby said inner conductors are spaced a predetermined distance by said insulating material to achieve a desired coupling characteristic.

2. A broadband directional coupler as claimed in claim 1 wherein said shielding sleeve of said first and second cables is used together with a solder material about said elongated openings with said mating surfaces in juxtaposed contact, said elongated openings being elongated rectangular openings formed in a straight section of said cables.

3. A broadband directional coupler as claimed in claim 1 wherein said first and second coaxial cables are bent along said connected section to provide a coupler of reduced length.

4. A broadband directional coupler as claimed in claim 1 wherein said first and second coaxial cables are flexible cables and twisted along said connected section to provide a coupler with a different topology of inputs and outputs.

5. A broadband directional coupler as claimed in claim 1 wherein said broadband directional coupler has a bandwidth of from 600 to 1000 MHz with a 30 dB directivity and having a low load VSWR in both said first and second coaxial cables.

6. A broadband directional coupler as claimed in claim 1 wherein said first and second coaxial cables are U-shaped cables defining opposed leg sections and an intermediate straight section, said cables being coupled along said intermediate straight sections.

7. A method of constructing a broadband directional coupler from a first and second flexible coaxial cable each having an inner conductor surrounded by an insulating material and a semi-rigid outer conductive shielding sleeve about said insulating material, said method comprising:

(i) cutting an elongated opening in said conductive shielding sleeve along a predetermined axial length;

(iii) forming a flat mating surface in said insulating material along a predetermined length in said elongated opening with said mating surface spaced from said inner conductor and extending substantially parallel to said inner conductor and disposed a predetermined distance by said insulating material from said inner conductor;

(iii) placing said mating surface of said first and second coaxial cables in facial juxtaposed contact with said first and second flexible coaxial cables being disposed in parallel alignment to one another along said predetermined axial length whereby said inner conductors are spaced a predetermined distance to achieve a desired coupling characteristic; and (iv) connecting said first and second coaxial cables to each other along said predetermined length of said flat mated surfaces with said shielding sleeve of said first and second cables in shielding contact with one another about said elongated openings.

8. A method as claimed in claim 7 wherein said step (iv) comprises fusing said shielding sleeve of said first and second coaxial cables together about said elongated openings.

9. A method as claimed in claim 8 wherein said sleeve of said first and second coaxial cables are soldered together about said elongated juxtaposed openings with said juxtaposed mating surfaces of said insulating material in contact.

10. A method as claimed in claim 7 wherein there is further provided the step of (v) securing coaxial connectors at each free end of said first and second coaxial cables.

11. A method as claimed in claim 10 wherein there is further provided the step of (vi) bending said connected conductor along said predetermined length that said shielding sleeve of each cable is in shielding contact to form a coupler of reduced length.

12. A method as claimed in claim 10 wherein there is further provided the step of (vii) twisting said connected conductor along said predetermined length in order to change the topology of the inputs and outputs.

13. A method as claimed in claim 7 wherein prior to step (i) there is provided the steps of bending each of said first and second coaxial cables to form a U-shaped cable defining opposed leg sections and an intermediate straight section, and wherein said steps (i) and (ii) are performed simultaneously by machining a predetermined portion of said intermediate section to remove a slice of said cable including said shielding sleeve and insulating material.

* * * * *